US009830849B2

(12) United States Patent
Wang et al.

(10) Patent No.: US 9,830,849 B2
(45) Date of Patent: Nov. 28, 2017

(54) ENTRY CONTROLLED INVERSION IMBALANCE COMPENSATION

(71) Applicant: APPLE INC., Cupertino, CA (US)

(72) Inventors: Chaohao Wang, Sunnyvale, CA (US); David S. Zalatimo, San Jose, CA (US); Lei Zhao, Santa Clara, CA (US); Christopher P. Tann, San Jose, CA (US); Paolo Sacchetto, Cupertino, CA (US); Sandro H. Pintz, Menlo Park, CA (US); Yi Huang, Santa Clara, CA (US); Jun Qi, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 423 days.

(21) Appl. No.: 14/617,564

(22) Filed: Feb. 9, 2015

(65) Prior Publication Data

US 2016/0232833 A1 Aug. 11, 2016

(51) Int. Cl.
*G09G 3/36* (2006.01)
*G09G 3/20* (2006.01)

(52) U.S. Cl.
CPC ..... *G09G 3/2092* (2013.01); *G09G 3/20* (2013.01); *G09G 2310/0254* (2013.01); *G09G 2310/04* (2013.01); *G09G 2310/08* (2013.01); *G09G 2320/0266* (2013.01); *G09G 2340/0435* (2013.01)

(58) Field of Classification Search
CPC ..... G09G 2310/08
See application file for complete search history.

(56) References Cited

U.S. PATENT DOCUMENTS

| | | | |
|---|---|---|---|
| 5,767,832 | A | 6/1998 | Koyama et al. |
| 7,333,096 | B2 | 2/2008 | Washio et al. |
| 7,659,876 | B2 | 2/2010 | Stessen et al. |
| 8,130,216 | B2 | 3/2012 | Washio et al. |
| 8,487,919 | B2 | 7/2013 | Kobayashi |

(Continued)

FOREIGN PATENT DOCUMENTS

| | | |
|---|---|---|
| CN | 1404027 A | 3/2003 |
| CN | 1619633 A | 5/2005 |

(Continued)

OTHER PUBLICATIONS

Partial International Search Report for PCT Application No. PCT/US2016/017159 dated Jun. 6, 2016; 7 pgs.

(Continued)

*Primary Examiner* — Jennifer Mehmood
*Assistant Examiner* — Carl Adams
(74) *Attorney, Agent, or Firm* — Fletcher Yoder PC

(57) ABSTRACT

One embodiment describes an electronic display that displays image frames with a first refresh rate or a second refresh rate, in which the second refresh rate is lower than the first refresh rate; a display driver that writes the image frames by applying voltage to a display panel; and a timing controller that receives first image data from an image source, in which the first image data describes a first image frame and a first desired refresh rate equal to the second fresh rate; and that instructs the display driver to apply a first set of voltage polarities to the display panel to display first image frame at the first refresh rate and to apply a second set of voltage polarities to the display the first image frame at the second refresh rate when polarity of inversion imbalance accumulated is equal to polarity of the first set of voltage polarities.

30 Claims, 9 Drawing Sheets

(56) References Cited

U.S. PATENT DOCUMENTS

| | | | | |
|---|---|---|---|---|
| 8,605,138 | B2 | 12/2013 | Son et al. | |
| 8,810,615 | B2 | 8/2014 | Takahashi et al. | |
| 8,830,155 | B2 | 9/2014 | Hsu et al. | |
| 9,293,095 | B2 | 3/2016 | Hsu et al. | |
| 9,299,316 | B2 | 3/2016 | Saitoh et al. | |
| 9,564,092 | B2 | 2/2017 | Fujioka et al. | |
| 2005/0104835 | A1 | 5/2005 | Misonou et al. | |
| 2007/0229465 | A1 | 10/2007 | Sakai et al. | |
| 2010/0265235 | A1 | 10/2010 | Lee | |
| 2014/0002431 | A1 | 1/2014 | Shibata et al. | |
| 2014/0368484 | A1 | 12/2014 | Tanaka et al. | |
| 2015/0002381 | A1 | 1/2015 | Fujioka et al. | |
| 2015/0243233 | A1* | 8/2015 | Bloks | G09G 3/3614 345/96 |
| 2016/0012787 | A1 | 1/2016 | Takahashi et al. | |

FOREIGN PATENT DOCUMENTS

| | | | |
|---|---|---|---|
| CN | 101676985 | A | 3/2010 |
| EP | 2109094 | A1 | 10/2009 |
| JP | 2009223259 | A | 10/2009 |
| JP | 4918039 | B2 | 4/2012 |
| KR | 10-0507544 | B1 | 8/2005 |
| KR | 10-2014-0040699 | A | 4/2014 |
| TW | 200639774 | | 11/2006 |
| TW | 200703223 | | 1/2007 |
| TW | 201115654 | | 5/2011 |
| TW | 201203209 | | 1/2012 |
| WO | 2014002607 | A1 | 1/2014 |
| WO | 2013/125406 | A1 | 7/2015 |

OTHER PUBLICATIONS

Utility Model Patentability Evaluation Report for Chinese Utility Model Application No. ZL201620116284.5 dated Oct. 31, 2016, 6 pgs.

Taiwanese Office Action for Taiwanese Application No. 105103192 dated Nov. 22, 2016; 3 pgs.

Korean WIPS Report for Korean Application No. 10-2017-7021014 dated Aug. 14, 2017; 17 pgs.

* cited by examiner

ENTRY CONTROLLED INVERSION IMBALANCE COMPENSATION

BACKGROUND

The present disclosure relates generally to an electronic display, and more particularly, to inversion imbalance compensation in an electronic display.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Generally, an electronic display may enable a user to perceive visual representations of information by successively writing image frames to a display panel of the electronic display. More specifically, an image frame may be displayed by applying positive polarity voltages and/or negative polarity voltages to the pixels in the display panel. For example, in a column inversion technique, positive polarity voltages may be applied to odd numbered columns and negative polarity voltages may be applied to even numbered columns to display a first image frame or first set of consecutive image frames. Subsequently, negative polarity voltages may be applied to the odd numbered columns and positive polarity voltage may be applied to the even numbered columns to display a second image frame or second set of consecutive image frames that occur after the first set of consecutive image frames.

As used herein, a "refresh rate" is intended to describe the frequency with which the image frames (e.g., first and second image frames) are written to the display panel. Accordingly, in some embodiment, adjusting the refresh rate of an electronic device may adjust the power consumption by the electronic display. For example, when the refresh rate is higher, the power consumption may also be higher. On the other hand, when the refresh rate is lower, the power consumption may also be lower.

In fact, in some embodiments, the refresh rate may be dynamic even between successively displayed image frames. For instance, continuing with the above example, the first image frame may be displayed with a refresh rate of 60 Hz and the second image frame may be displayed with a refresh rate of 30 Hz. As such, the negative polarity voltages may be applied to the odd numbered columns for twice as long as the positive polarity voltages. Similarly, the positive polarity voltage may be applied to the even numbered columns for twice as long as the negative polarity voltages. However, since the duration the opposite polarity voltages are applied to the display panel may be different when the refresh rate is variable, an inversion imbalance (e.g., polarization, also referred to as a bias voltage) may be accumulated in the display panel and reduce image quality.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure generally relates to improving quality of images displayed on an electronic display particularly when refresh rate of the electronic display is dynamic. More specifically, when the refresh rate is dynamic, the duration each successive image is displayed may vary. As such, when inversion techniques vary between applying positive polarity and negative polarity voltages to display an image frame, inversion imbalance may accumulate, thereby polarizing the pixels and reducing image quality.

Accordingly, the techniques described herein may reduce the polarization that occurs in pixels of an electronic display by accounting for the polarity and duration voltages are applied to display each image frame. In some embodiments, a timing controller in the electronic display may determine duration voltages are applied to display each image frame based on the number of lines included in corresponding image data received from an image source. Additionally, the timing controller may determine the polarity of voltages to display each frame based at least in part on inversion imbalance (e.g., polarization) accumulated in the pixels of the electronic display. For example, the timing controller may count up when a first set of voltage polarities (e.g., positive polarity applied to odd columns and negative polarity applied to even columns) is applied to the electronic display pixels and count down when a second set of voltage polarities (e.g., negative polarity applied to odd columns and positive polarity applied to even columns) is applied to the electronic display pixels. As such, the timing controller may reduce the accumulated inversion imbalance in the electronic display by applying voltage polarities that trend the counter value toward zero.

In some embodiments, the possibility of a perceivable luminance spike may be reduced by alternating the polarity of voltage applied to each pixel between positive and negative to successively display image frames. Thus, to reduce or at least maintain (e.g., not make worse) the inversion imbalance of the pixels, image frames displayed at a reduced refresh rate (e.g., less than 60 Hz) may be written to the pixels using a set of voltage polarities opposite the accumulated inversion imbalance of the display panel. Furthermore, in some embodiments, to reduce the perceivability of a reduced refresh rate, step-down intermediate refresh rates may be used. Thus, to reduce or at least maintain (e.g., not make worse) the inversion imbalance of the pixels, an even number of image frames may be displayed at each step-down intermediate refresh rate. In other words, the techniques described herein may reduce the possibility of visual artifacts caused by inversion imbalance while also reducing the possibility of luminance spikes and/or the perceivability of a reduced refresh rate in an electronic display.

BRIEF DESCRIPTION OF THE DRAWINGS

Various aspects of this disclosure may be better understood upon reading the following detailed description and upon reference to the drawings in which.

DETAILED DESCRIPTION

Figure 1:
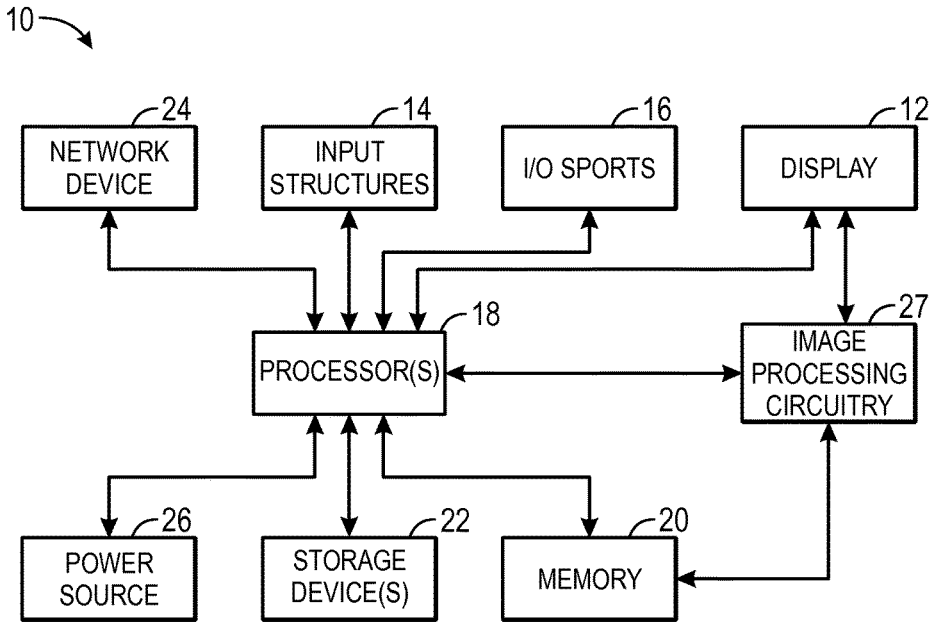
FIG. 1 is a block diagram of a computing device used to display image frames, in accordance with an embodiment.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As mentioned above, an electronic display may display image frames by applying voltage to the pixels on a display panel. More specifically, the pixels may transmit light based at least in part on the magnitude of the voltage applied. However, when a direct current (DC) voltage is applied to the pixel for extended periods of time, inversion imbalance may accumulate in the pixels, thereby polarizing the pixels and reducing the displayed image quality. For example, when a positive voltage is applied to a pixel for an extended period of time, the pixel may begin to be polarized positive. As such, when a voltage is applied to the pixel, the positive polarization may cause the pixel to have a higher voltage than the applied voltage, which causes the pixel to inaccurately transmit light (e.g., a visual artifact).

Thus, it may be beneficial to utilize inversion balancing techniques to reduce the occurrence of such visual artifacts. More specifically, the possibility of polarizing a pixel may be reduced by alternating between applying positive polarity voltage and negative polarity voltages to the pixel. As used herein, a "set of voltage polarities" is intended to describe the voltage polarities applied to the pixels to display an image frame. In other words, inversion techniques generally alternate between applying a first set of voltage polarities and applying a second set of voltage polarities, such that voltage polarity applied to each pixel is positive when one set of voltage polarities is applied and negative when the other set of voltage polarities is applied.

For example, in a column inversion technique, the first set of voltage polarities may include applying positive polarity voltages to odd numbered columns and negative polarity voltages to even numbered columns, and the second set of voltage polarities may include applying negative polarity voltages to the odd numbered columns and positive polarity voltages to the even numbered columns. In other words, a first image frame may be displayed by applying the first set of voltage polarities to the pixels and a successively displayed second image frame may be displayed by applying the second set of image polarities. As such, at a constant refresh rate, the opposite polarity voltages applied to each pixel may cancel each other out and reduce the risk of inversion imbalance (e.g., polarization).

However, in some embodiments, an electronic display may have the capability to switch to a dynamic variable refresh rate. For example, the electronic display may switch from utilizing a normal refresh rate (e.g., 60 Hz per frame) to a reduced refresh rate (e.g., 45 Hz or 30 Hz per frame) and vice versa. As used herein, the "normal refresh rate" is intended to describe the refresh rate that enables the electronic display to display both static and dynamic content, and the "reduced refresh rate" is intended to describe any refresh rate lower than the normal refresh rate. For example, when a dynamic variable refresh rate is used, the refresh rate used to display the first image frame may be different from the refresh rate used to display the second image frame. In other words, the duration each set of voltage polarities is held in the pixels may vary.

In such embodiments, even alternating the polarity of the voltage applied to the pixels may still result in polarization of the pixels. For example, in an extreme case, a first image frame may be displayed at 30 Hz by applying the first set of voltage polarities, a second image frame may be displayed at 60 Hz by applying the second set of voltage polarities, a third image frame may be displayed at 30 Hz by applying the first set of voltage polarities, a fourth image frame may be displayed at 60 Hz by applying the second set of voltage polarities, and so on. In such a case, over an extended period, pixels in the odd columns may be polarized positive and the pixels in the even columns may be polarized negative.

Accordingly, as will be described in more detail below, the techniques described herein may reduce the inversion imbalance (e.g., polarization) that accumulates in pixels of an electronic display by accounting for the polarity and duration voltages are held at the pixel to display each image frame. For example, in some embodiments, an electronic display may include a display panel, which displays image frames with varying refresh rates, and a timing controller. More specifically, the timing controller may receive image data from an image source, determine polarization of the display panel, and instruct a driver in the electronic display to apply a voltage to the display panel to write an image frame on the display panel based at least in part on the polarization of the display panel. For example, to determine the polarization, the timing controller may use a counter that counts up when the first set of voltage polarities is applied and counts down when the second set of voltage polarities is applied. As such, the timing controller may reduce the inversion imbalance accumulated in the display panel by applying the set of voltage polarities that trends the counter value toward zero.

However, in some embodiments, using the same set of voltage polarities to display successive image frames may cause a perceivable luminance spike. As such, the techniques described herein may reduce the possibility of a perceivable luminance spike by alternating between the first set of voltage polarities and the second set of voltage polarities to display successive image frames. Thus, to reduce or at least maintain (e.g., not make worse) the inversion imbalance of the pixels, image frames displayed at a reduced refresh rate (e.g., less than 60 Hz) may be written to the pixels using the set of voltage polarities opposite the polarization of the display panel. For example, when pixels in the odd columns are polarized negative and pixels in the even columns are polarized positive, an image frame displayed at a reduced refresh rate may be displayed by applying a first set of voltage polarities (e.g., positive polarity applied to odd columns and a negative polarity applied to even columns). On the other hand, when pixels in the odd columns are polarized positive and pixels in the even columns are polarized negative, an image frame displayed at a reduced refresh rate may be displayed by applying the second set of voltage polarities (e.g., negative polarity applied to odd columns and a positive polarity applied to even columns).

Furthermore, abruptly reducing the refresh rate with which successive image frames are displayed may increase perceivability of the change in refresh rate. Accordingly, in some embodiments, step-down intermediate refresh rates (e.g., 45 Hz) may be used to gradually step down to a target refresh rate (e.g., 30 Hz). Thus, to reduce or at least maintain (e.g., not make worse) the inversion imbalance of the pixels, an even number of image frames may be displayed at each step-down intermediate refresh rate. For example, a first image frame may be displayed at 60 Hz by applying the first set of voltage polarities, a second image frame may be displayed at a step-down intermediate refresh rate of 45 Hz by applying the second set of voltage polarities, a third image frame may be displayed at the step-down intermediate refresh rate of 45 Hz by applying the first set of voltage priorities, and a fourth image frame may be displayed at a target reduced refresh rate of 30 Hz by applying the second set of voltage polarities.

Additionally, to further reduce the inversion imbalance, a dynamic refresh rate may be used such that image frames written with a first set of voltage polarities having the same polarity as the inversion imbalance may be displayed for a shorter duration (e.g., higher refresh rate), whereas image frames written with a second set of voltage polarities have the opposite polarity as the inversion imbalance may be displayed for a longer duration (e.g., lower refresh rate). For example, when pixels in the odd columns are polarized negative and pixels in the even columns are polarized positive, a first image frame displayed by applying a first set of voltage polarities (e.g., positive polarity applied to odd columns and a negative polarity applied to even columns) at a higher refresh rate (e.g., 65 Hz) and a second image frame displayed by applying a second set of voltage polarities (e.g., negative polarity applied to odd columns and a positive polarity applied to even columns) at a lower refresh rate (e.g., 55 Hz).

In other words, the techniques described herein may reduce the likelihood of visual artifacts caused by inversion imbalance while also reducing the possibility of luminance spikes and/or the perceivability of a reduced refresh rate in the electronic display. To help illustrate, a computing device 10 that utilizes an electronic display 12 to display image frames is described in FIG. 1. As will be described in more detail below, the computing device 10 may be any suitable computing device, such as a handheld computing device, a tablet computing device, a notebook computer, and the like.

Accordingly, as depicted, the computing device 10 includes the display 12, input structures 14, input/output (I/O) ports 16, one or more processor(s) 18, memory 20, nonvolatile storage 22, a network interface 24, a power source 26, and image processing circuitry 27. The various components described in FIG. 1 may include hardware elements (including circuitry), software elements (including computer code stored on a non-transitory computer-readable medium), or a combination of both hardware and software elements. It should be noted that FIG. 1 is merely one example of a particular implementation and is intended to illustrate the types of components that may be present in the computing device 10. Additionally, it should be noted that the various depicted components may be combined into fewer components or separated into additional components. For example, the image processing circuitry 27 (e.g., a graphics processing unit) may be included in the one or more processors 18.

As depicted, the processor 18 and/or image processing circuitry 27 are operably coupled with memory 20 and/or nonvolatile storage device 22. More specifically, the processor 18 and/or image processing circuitry 27 may execute instruction stored in memory 20 and/or non-volatile storage device 22 to perform operations in the computing device 10, such as generating and/or transmitting image data. As such, the processor 18 and/or image processing circuitry 27 may include one or more general purpose microprocessors, one or more application specific processors (ASICs), one or more field programmable logic arrays (FPGAs), or any combination thereof. Additionally, memory 20 and/or non volatile storage device 22 may be a tangible, non-transitory, computer-readable medium that stores instructions executable by and data to be processed by the processor 18 and/or image processing circuitry 27. In other words, the memory 20 may include random access memory (RAM) and the non-volatile storage device 22 may include read only memory (ROM), rewritable flash memory, hard drives, optical discs, and the like. By way of example, a computer program product containing the instructions may include an operating system or an application program.

Additionally, as depicted, the processor 18 is operably coupled with the network interface 24 to communicatively couple the computing device 10 to a network. For example, the network interface 24 may connect the computing device 10 to a personal area network (PAN), such as a Bluetooth network, a local area network (LAN), such as an 802.11x Wi-Fi network, and/or a wide area network (WAN), such as a 4G or LTE cellular network. Furthermore, as depicted, the processor 18 is operably coupled to the power source 26, which provides power to the various components in the computing device 10. As such, the power source 26 may includes any suitable source of energy, such as a rechargeable lithium polymer (Li-poly) battery and/or an alternating current (AC) power converter.

As depicted, the processor 18 is also operably coupled with I/O ports 16, which may enable the computing device 10 to interface with various other electronic devices, and input structures 14, which may enable a user to interact with the computing device 10. Accordingly, the inputs structures 14 may include buttons, keyboards, mice, trackpads, and the like. Additionally, in some embodiments, the display 12 may include touch sensitive components.

In addition to enabling user inputs, the display 12 may display image frames, such as a graphical user interface (GUI) for an operating system, an application interface, a still image, or a video. As depicted, the display is operably coupled to the processor 18 and the image processing circuitry 27. Accordingly, the image frames displayed by the display 12 may be based on image data received from the processor 18 and/or the image processing circuitry 27.

As will be described in more detail below, image data received by the display 12 may be used to determine the refresh rate with which a corresponding image frame is displayed. For example, the processor 18 and/or the image processing circuitry 27 may communicate a desired refresh rate to use based on the number of vertical blank (Vblank) lines include in the image data. Generally, the number of lines (e.g., vertical blank and active lines) may directly correspond with duration an image frame is displayed because the time it takes for the display 12 to write one line is generally constant. For example, when a displayed image frame has a resolution of 2880×1800 and is displayed at 60 Hz, the image data may include 52 vertical blank lines and 1800 active lines. Thus, the duration the image frame is displayed may be described as 1852 lines.

Figure 2:
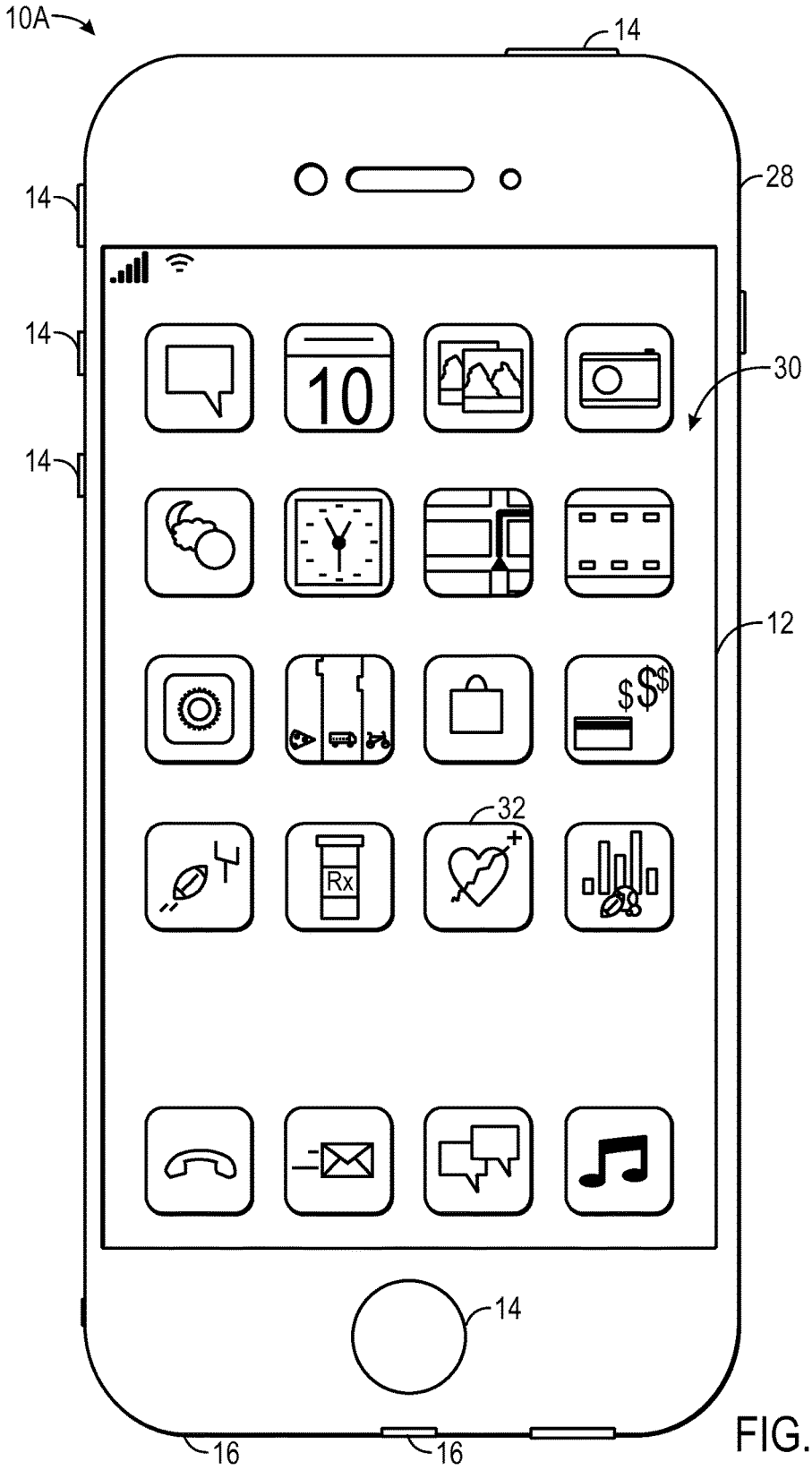
FIG. 2 is an example of the computing device of FIG. 1, in accordance with an embodiment.

As described above, the computing device 10 may be any suitable electronic device. To help illustrate, one example of a handheld device 10A is described in FIG. 2, which may be a portable phone, a media player, a personal data organizer, a handheld game platform, or any combination of such devices. For example, the handheld device 10A may be any model of an iPod or iPhone available from Apple Inc.

As depicted, the handheld device 10A includes an enclosure 28, which may protect interior components from physical damage and to shield them from electromagnetic interference. The enclosure 28 may surround the display 12, which, in the depicted embodiment, displays a graphical user interface (GUI) 30 having an array of icons 32. By way of example, when an icon 32 is selected either by an input structure 14 or a touch sensing component of the display 12, an application program may launch.

Additionally, as depicted, input structure 14 may open through the enclosure 28. As described above, the input structures 14 may enable a user to interact with the handheld device 10A. For example, the input structures 14 may activate or deactivate the handheld device 10A, navigate a user interface to a home screen, navigate a user interface to a user-configurable application screen, activate a voice-recognition feature, provide volume control, and toggle between vibrate and ring modes. Furthermore, as depicted, the I/O ports 16 open through the enclosure 28. In some embodiments, the I/O ports 16 may include, for example, an audio jack to connect to external devices.

Figure 3:
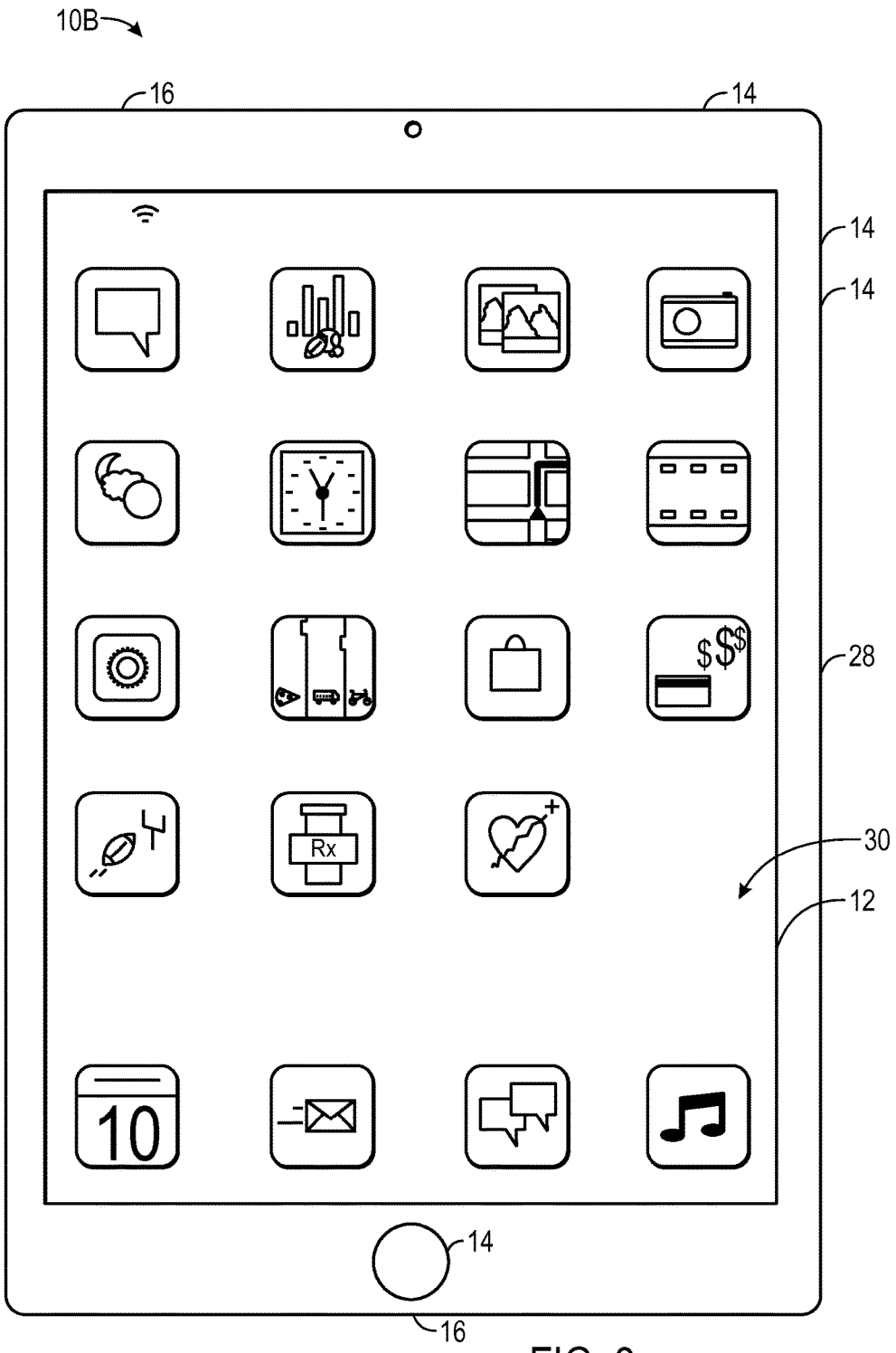
FIG. 3 is an example of the computing device of FIG. 1, in accordance with an embodiment.
Figure 4:
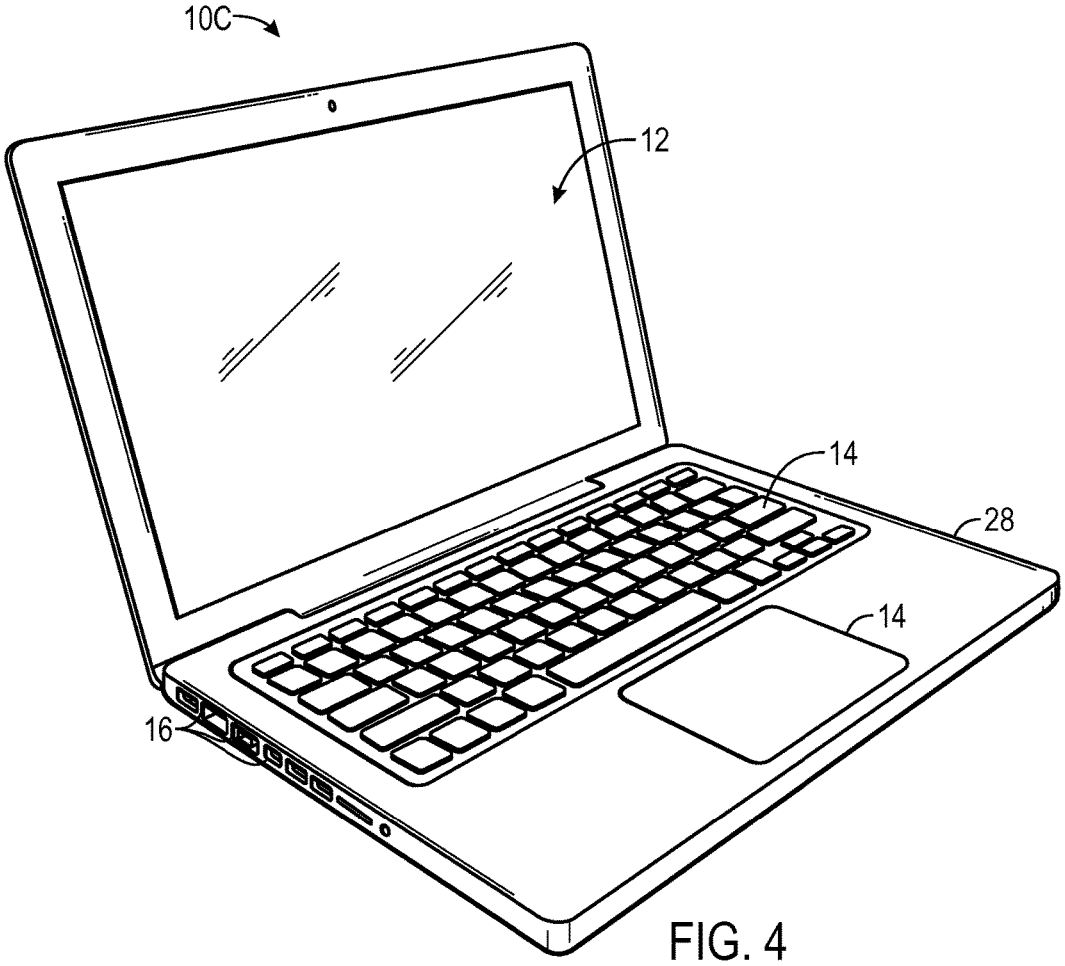
FIG. 4 is an example of the computing device of FIG. 1, in accordance with an embodiment.

To further illustrate a suitable computing device 10, a tablet device 10B is described in FIG. 3, such as any model of an iPad available from Apple Inc. Additionally, in other embodiments, the computing device 10 may take the form of a computer 10C as described in FIG. 4, such as any a MacBook or iMac available from Apple Inc. As depicted, the computer 10C also includes a display 12, input structures 14, I/O ports 16, and a housing 28.

Figure 5:
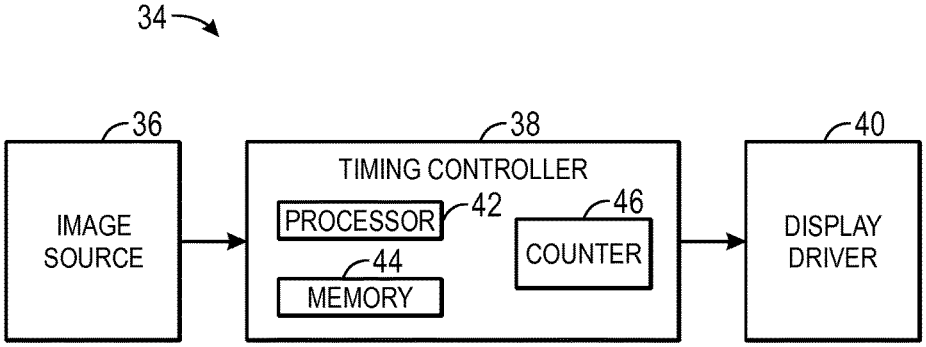
FIG. 5 is block diagram of a portion of the computing device of FIG. 1 used to display image frames, in accordance with an embodiment.

As described above, the display 12 may display image frames based on image data received from the processor 18 and/or the image processing circuitry 27. More specifically, the image data may be processed by any combination of the processor 18, the image processing circuitry 27, and the display 12 itself. To help illustrate, a portion 34 of the computing device 10 that processes and communicates image data is described in FIG. 5.

As depicted, the portion 34 of the computing device 10 includes an image source 36, a timing controller (TCON) 38, and a display driver 40. More specifically, the image source 36 may generate image data and transmit the image data to the timing controller 38. Accordingly, in some embodiments, the source 36 may be the processor 18 and/or the image processing circuitry 27. Additionally, the timing controller 38 may analyze the received image data and instruct the driver 40 to write an image frame to the pixels by applying a voltage to the display panel of the electronic display 12. As such, in some embodiments, the timing controller 38 and the display driver 40 may be included in the electronic display 12.

To facilitate processing/analyzing the image data and/or performing other operations, the timing controller 38 may include a processor 42 and memory 44. In some embodiments, the timing controller processor 42 may be included in the processor 18 and/or the image processing circuitry 27. In other embodiments, the timing controller processor 42 may be a separate processing module. Additionally, in some embodiments, the timing controller memory 44 may be included in memory 20, storage device 22, or another tangible, non-transitory, computer readable medium. In other embodiments, the timing controller memory 44 may be a separate tangible, non-transitory, computer readable medium that stores instructions executable by the timing controller processor 42.

More specifically, the timing controller 38 may analyze the received image data to determine the magnitude of voltage to apply to each pixel to achieve the desired image frame and instruct the driver 40 accordingly. Additionally, the timing controller 38 may analyze the received image data to determine the desired refresh rate with which to display the image frame described by the image data and instruct the driver 40 accordingly.

In some embodiments, the timing controller 38 may determine the desired refresh rate based at least in part on the number of vertical blank (Vblank) lines and/or active lines included in the image data. For example, when the display 12 displays image frames with a resolution of 2880×1800, the timing controller 38 may instruct the driver 40 to display a first image frame at 60 Hz when the timing controller 38 determines that the corresponding image data includes 52 vertical blank lines and 1800 active lines. Additionally, the timing controller 38 may instruct the driver 40 to display a second image frame at 30 Hz when the timing controller 38 determine that the corresponding image data includes 1904 vertical blank lines and 1800 active lines.

Since each row of pixels in the display panel is successively written, the duration an image frame is displayed may include the number of active lines in corresponding image data. Additionally, when a vertical blank line in the corresponding image data is received, the displayed image frame may continue to be displayed. As such, the total duration an image frame is displayed may be described as the sum of the number of vertical blank lines and the number of active lines in the corresponding image data. To help illustrate, continuing with the above example, the duration the first image frame is displayed may be 1852 lines and the duration the second image frame is displayed may be 3704 lines. In other words, a line may be used herein to represent a unit of time.

As described above, the duration positive and negative voltages are applied to the display panel may polarize the pixels in the electronic display 12. As such, in some embodiments, the timing controller 38 may utilize a counter 46 to keep track of duration each sets of voltage polarities are held by incrementing/decrementing. For example, the counter 46 may increment the number of lines included in image data when the corresponding image frame is displayed with the first set of voltage polarities. On the other hand, the counter 46 may decrement the number of lines included in image data when the corresponding image frame is displayed with the second set of voltage polarities. Additionally or alternatively, the counter 46 may include a timer that keeps track of time each sets of voltage polarities are held.

Figure 6:
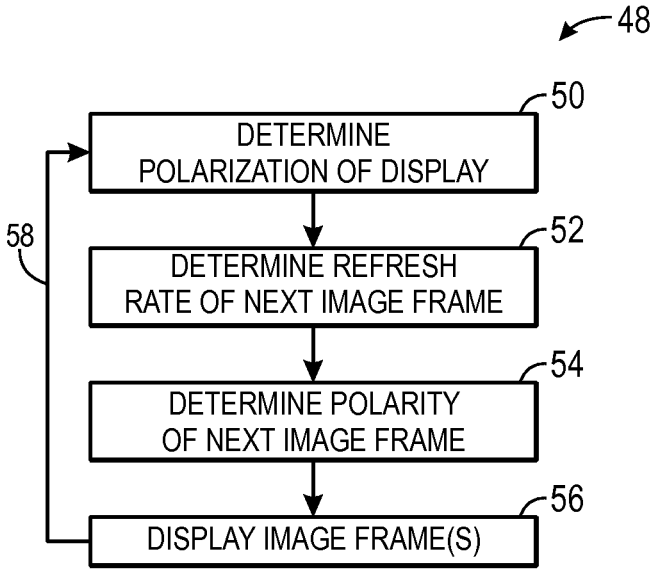
FIG. 6 is a flow diagram of a process for successively displaying image frames on an electronic display, in accordance with an embodiment.

As such, the timing controller 38 may reduce the inversion imbalance accumulated in pixels of the electronic display 12 by displaying subsequent image frames using a set of voltage polarities that trends the counter value toward zero. To help illustrate, one embodiment of a process 48 for successively displaying image frames on the electronic display 12 is described in FIG. 6. Generally, the process 48 includes determining polarization of the electronic display (process block 50), determining refresh rate with which to display a next image frame (process block 52), determining voltage polarity with which to display the next image frame (process block 54), displaying image frame(s) (process block 56), and returning to process block 52 (arrow 58). In some embodiments, the process 48 may be implemented using instructions stored in the timing controller memory 44 and/or another suitable tangible non-transitory computer-readable medium and executable by the timing controller processor 42 and/or another suitable processing circuitry.

Accordingly, when image data is received from the image source 36, the timing controller 38 may determine the polarization of the electronic display 12 (process block 50). More specifically, the timing controller 38 may poll the counter 46 to determine the counter value. Based on the counter value, the timing controller 38 may determine whether the electronic display 12 is polarized toward the first set of voltage polarities or the second set of voltage polarities. For example, when the counter value is greater than zero, the timing controller 38 may determine that the electronic display 12 is polarized toward the first set of voltage polarities. On the other hand, when the counter value is less than zero, the timing controller 38 may determine that the electronic display 12 is polarized toward the second set of voltage polarities.

Additionally, the timing controller 38 may determine a refresh rate with which to display a next image frame (process block 52). More specifically, the timing controller 38 may determine the desired refresh rate based at least in part on the number lines (e.g., active and blank lines) included in the image data received from the image source 36. For example, when the display 12 has a resolution of 2880×1800, the timing controller 38 may determine that the desired refresh rate of a corresponding image frame is 60 Hz when the image data includes 52 vertical blank lines and 1800 active lines. Additionally, the timing controller 38 may determine that the desired refresh rate of a corresponding image frame is 30 Hz when the image data includes 1904 vertical blank lines and 1800 active lines.

However, at times, the refresh rate with which to display the next image frame may deviate from the desired refresh rate to reduce or at least maintain inversion imbalance in the pixels. More specifically, as will be described I more detail below, the refresh rate may be determined such that image frames displayed using a set of voltage polarities equal to polarization of the electronic display 12 are displayed for a lesser or equal duration. For example, when the desired refresh rate is a normal refresh rate, such as 60 Hz, the determined refresh rate (e.g., 65 Hz) may be greater than the desired refresh rate to facilitate reducing the inversion imbalance.

Additionally, when the desired refresh rate is a reduced refresh rate, such as 30 Hz, displaying the next image frame at the desired refresh rate may increase the inversion imbalance accumulated in the electronic display 12. For example, when the electronic display 12 is polarized toward the first set of voltage polarities, displaying the next image frame with the first set of voltage polarities at a reduced refresh rate may increase polarization toward the first set of voltage polarities. Instead, in some embodiments, the next image frame may be displayed at a normal refresh rate (e.g., 60 Hz) and the following image frame may be displayed at the desired refresh rate (e.g., 30 Hz).

Accordingly, the timing controller 38 may determine the set of voltage polarities with which to display the next image frame (process block 54). As described above, the likelihood of a luminance spike may be reduced by alternating between the first set of voltage polarities and the second set of voltage polarities such that the polarity applied to each pixel switches between positive and negative to display successive image frames. As such, the timing controller 38 may determine that the set of voltage polarities with which to display the next image frame is opposite the set of voltage polarities used to display the directly previous image frame. For example, when the previous image frame is displayed using the first set of voltage polarities, the timing controller 38 may determine that the next image frame should be displayed with the second set of voltage polarities.

The timing controller 38 may then instruct the display driver 40 to display one or more image frames by applying sets of voltage polarities to the pixels on the display panel (process block 56). More specifically, the timing controller 38 may instruct the display driver 40 to display the next image frame by applying the determined set of voltage polarities at the determined refresh rate to the display 12. Additionally, when the determined refresh rate is not the desired refresh rate, the timing controller 38 may instruct the display driver 40 to subsequently display an image frame at the desired refresh rate.

In other words, to reduce or at least maintain polarization of the electronic display 12, the next image frame may be displayed at a normal refresh rate (e.g., 60 Hz) even when the desired refresh rate is a reduced refresh rate (e.g., 30 Hz). For example, the next image frame may first be displayed at the normal refresh rate (e.g., 60 Hz) by applying the first set of voltage polarities and subsequently repeated at the desired reduced refresh rate by applying the second set of voltage polarities. In this manner, the polarization of the display panel toward the first set of voltage polarities may be decreased.

Figure 7:
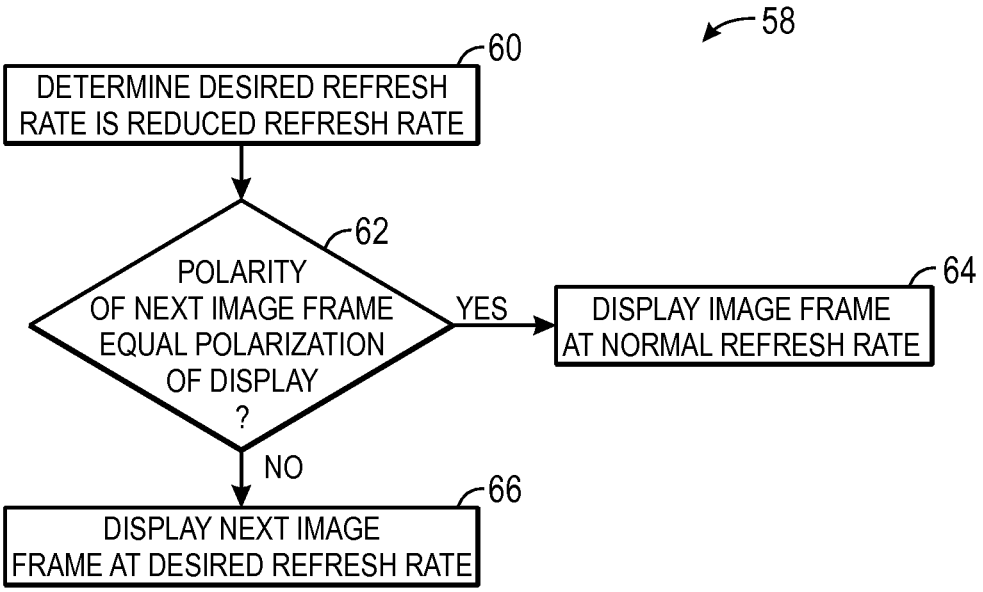
FIG. 7 is a flow diagram of a process for determining refresh rate with which to display image frames, in accordance with an embodiment.

To help illustrate, a process 58 for determining refresh rate with which to display one or more image frames is described in FIG. 7. Generally, the process 58 includes determining that a desired refresh rate is a reduced refresh rate (process block 60), determining whether polarity with which to display a next image frame is equal to the polarization of the electronic display (decision block 62), displaying an image frame at a normal refresh rate when the polarity with which to display the next image frame is equal to the polarization of the electronic display (process block 64), and displaying an image frame at the desired refresh rate (process block 66). In some embodiments, the process 58 may be implemented using instructions stored in the timing controller memory 44 and/or another suitable tangible non-transitory computer-readable medium and executable by the timing controller processor 42 and/or another suitable processing circuitry.

Accordingly, the timing controller 38 may determine whether the desired refresh rate is a reduced refresh rate (process block 60). In some embodiments, the normal refresh rate (e.g., 60 Hz) may be stored in memory 44. Accordingly, the timing controller 38 may retrieve and compare the normal refresh rate with the desired refresh rate. More specifically, when the desired refresh rate is less than the normal refresh rate, the timing controller 38 may determine that the desired refresh rate is a reduced refresh rate.

The timing controller 38 may then determine whether polarity with which to display the next image frame is equal to the polarization of the electronic display 12 (decision block 62). In some embodiments, an indication of the set of voltage polarities with which to display the next image frame and an indication of the polarization of the electronic display 12 (e.g., counter value) may be stored in memory 44. Accordingly, the timing controller 38 may retrieve and compare the set of voltage polarities with which to display the next image frame with the polarization of the electronic display 12.

When the timing controller 38 determines that their polarities are equal, the timing controller 38 may instruct the display driver 40 to display the next image frame at a normal refresh rate (process block 64) and display a following image frame at the desired reduced refresh rate (process block 66). On the other hand, when the timing controller 38 determines that they are not equal, the timing controller 38 may instruct the display driver 40 to display the next image frame at the desired reduced refresh rate (process block 66). In this manner, the polarization of the electronic display 12 may be decreased or at least maintained by displaying reduced refresh rate image frames with a set of voltage polarities opposite the polarization of the electronic display 12.

As described above, various inversion techniques may be used to write image frames to the electronic display 12. However, in each inversion technique, the voltage polarity applied to a pixel to successively display image frames generally alternates between positive and negative polarities. For example, in a column inversion technique a first set of voltage polarities may apply a positive polarity voltage to the odd columns and a negative polarity voltage to the even columns. As such, when the first set of voltage polarities is applied, a pixel in an odd column may adjust toward a positive polarization and a pixel in an even column may adjust toward a negative polarization. Moreover, since the first set of voltage polarities is applied to each of the pixels for approximately the same duration, the change in polarization for each of the pixels may generally be the same.

In fact, it may be possible to extrapolate the determined refresh rate of a single pixel to each of the pixels on the electronic display. In other words, the determined refresh rate may be the same whether based on a single pixel or the display panel as a whole. As such, process 58A as it relates to a single pixel is described in FIG. 8.

Figure 8:
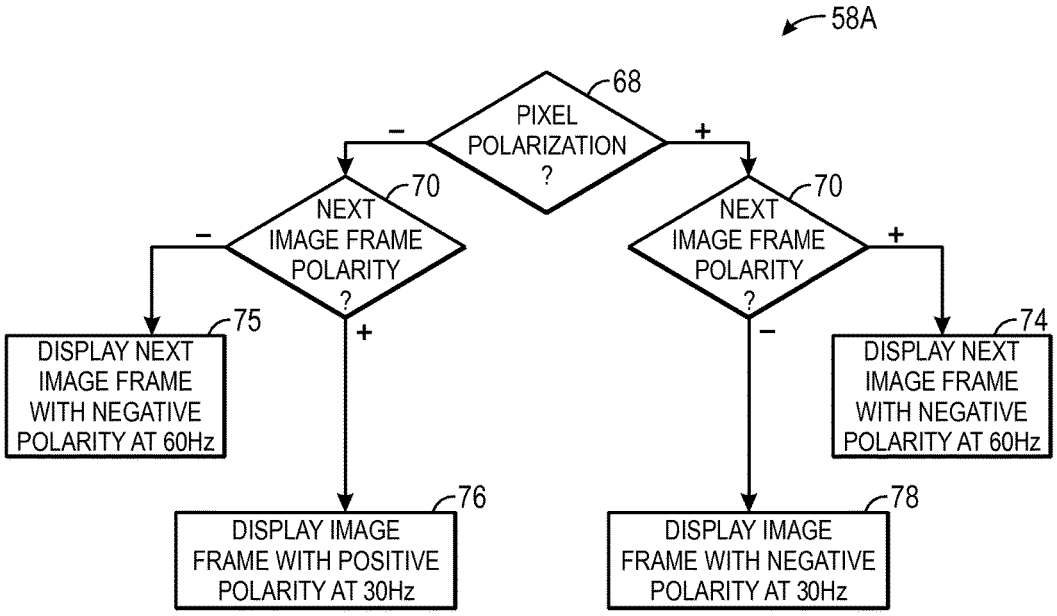
FIG. 8 is a flow diagram of a process for determining refresh rate with which to display the image frames in relation to a single pixel, in accordance with an embodiment.

As described in FIG. 8, the timing controller 38 may determine the polarization of the pixel (decision block 68), for example, based on the counter value. Additionally, the timing controller 38 may determine voltage polarity that may be applied to the pixel to display the next image frame (decision block 70), for example, based on the alternating pattern of applied voltage polarities.

Based on the polarization of the pixel and the voltage polarity that may be applied to display the next image frame, the timing controller 38 may then determine the refresh rate with which to display the next image frame. More specifically, when the pixel polarization and the voltage polarity with which to display the next image frame are both negative, the timing controller 38 may instruct the electronic display 12 to display the next image frame at 60 Hz (e.g., normal refresh rate) (process block 72) and display a following image frame at 30 Hz (e.g., desired reduced refresh rate) using a positive polarity voltage (process block 76). Similarly, when the pixel polarization and the voltage polarity with which to display the next image frame are both positive, the timing controller 38 may instruct the electronic display 12 to display the next image frame at 60 Hz (process block 74) and display the following image frame at 30 Hz using a negative polarity voltage (process block 78). On the other hand, when the pixel polarization and the next voltage polarity are different, the timing controller 38 may instruct the electronic display 12 to display the next image frame at 30 Hz (process blocks 76 and 78).

To help illustrate the techniques, a hypothetical display operation 80 is described in FIG. 8 with regard to a single pixel. More specifically, the hypothetical display operation 80 describes image frames displayed on the electronic display 12 between t0 and t6. Additionally, a counter value plot 82 describes the counter value in relation to the hypothetical display operation 80.

In the depicted embodiment, the timing controller 38 may receive first image data at t0, which has a desired reduced refresh rate. In fact, the desired refresh rate may be the lowest possible refresh rate used by the electronic display. Based on the first image data, the timing controller 38 may instruct the display driver 40 to apply the first set of voltage polarities to the display panel at the reduced refresh rate to display a first image frame between t0 and t1. More specifically, the first set of voltage polarities may apply a negative polarity voltage to the pixel. Thus, as depicted, the counter value decreases between t0 and t1 to indicate the duration the negative polarity voltage is applied to the pixel (e.g., duration the first set of voltage polarities is applied to the display panel).

At t1, the timing controller 38 may receive second image data, which has a desired normal refresh rate (e.g., 60 Hz). Based on the second image data, the timing controller 38 may instruct the display driver 40 to apply a second set of voltage polarities to the display panel at the normal refresh rate to display a second image frame between t1 and t2. More specifically, the second set of voltage polarities may apply a positive polarity voltage to the pixel. Thus, as depicted, the counter value increases between t1 and t2 to indicate the duration the positive polarity voltage is applied to the pixel (e.g., duration the second set of voltage polarities is applied to the display panel).

At t2, the timing controller 38 may receive third image data, which has a desired normal refresh rate (e.g., 60 Hz). Based on the third image data, the timing controller 38 may instruct the display driver 40 to apply the first set of voltage polarities to the display panel at the normal refresh rate to display a third image frame between t2 and t3. Thus, as depicted, the counter value decreases between t2 and t3 to indicate the duration the negative polarity voltage is applied to the pixel.

At t3, the timing controller 38 may receive fourth image data, which has a desired reduced refresh rate (e.g., 30 Hz). Since the desired refresh rate is a reduced refresh rate, the timing controller 38 may compare the voltage polarity with which to display the next image frame and polarization of the pixel. More specifically, since the third image frame was displayed by applying a negative polarity, the timing controller 38 may determine that the next image frame may be displayed by applying a positive polarity. Additionally, the timing controller 38 may determine that the pixel is polarized negative because the counter value is negative.

Since the polarities are opposite, the timing controller 38 may instruct the display driver 40 to apply the second set of voltage polarities to the display panel at the reduced refresh rate to display a fourth image frame between t3 and t4 based on the fourth image data. Thus, as depicted, the counter value increases between t3 and t4 to indicate the duration the positive polarity voltage is applied to the pixel.

At t4, the timing controller 38 may receive fifth image data, which has a desired reduced refresh rate (e.g., 30 Hz). Since the desired refresh rate is a reduced refresh rate, the timing controller 38 may determine that the polarity with which to display a next image is negative and that the pixel is polarized negative because the counter value is negative. Since the polarities are the same, the timing controller 38 may instruct the display driver 40 to apply the first set of voltage polarities to the display panel at the normal refresh rate to display a fifth image frame. In some embodiments, the fifth image frame may be displayed based on the fourth image data (e.g., repeat display of fourth image frame) or based on the fifth image data. Regardless, as depicted, the counter value decreases between t4 and t5 to indicate the duration the negative polarity voltage is applied to the pixel.

Based on the fifth image data, the timing controller 38 may then instruct the display driver 40 to apply the second set of voltage polarities to the display panel at the desired reduced refresh rate to display a sixth image frame (e.g., repeat display of fifth image frame) between t5 and t6. Thus, as depicted, the counter value increases between t5 and t6 to indicate the duration the positive polarity voltage is applied to the pixel.

In this manner, the inversion imbalance accumulated by the pixel and the display panel as a whole may be gradually reduced. In fact, since image frames displayed at a reduce refresh rate are displayed using a set of voltage polarities opposite the accumulated inversion imbalance, the amount of inversion imbalance may be bounded, for example, by the amount of polarization caused by displaying an image frame at the lowest possible refresh rate. For example, in the depicted embodiment, the inversion imbalance accumulated may be bounded by the value at t1. In other words, inversion imbalance may stay within a bounded range, which decreases the likelihood of the inversion imbalance causing perceivable visual artifacts.

Figure 9:
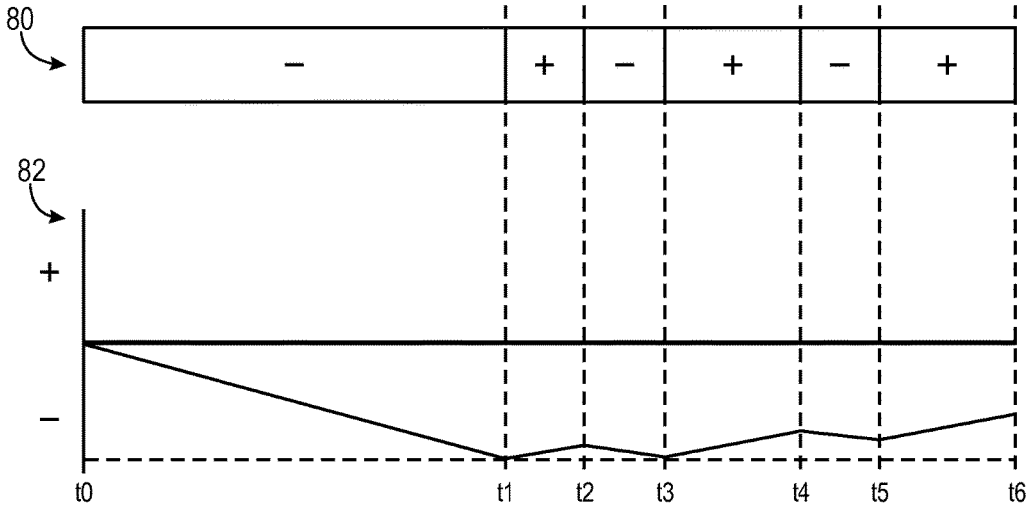
FIG. 9 is an example of a first hypothetical operation of an electronic display, in accordance with an embodiment.
Figure 10:
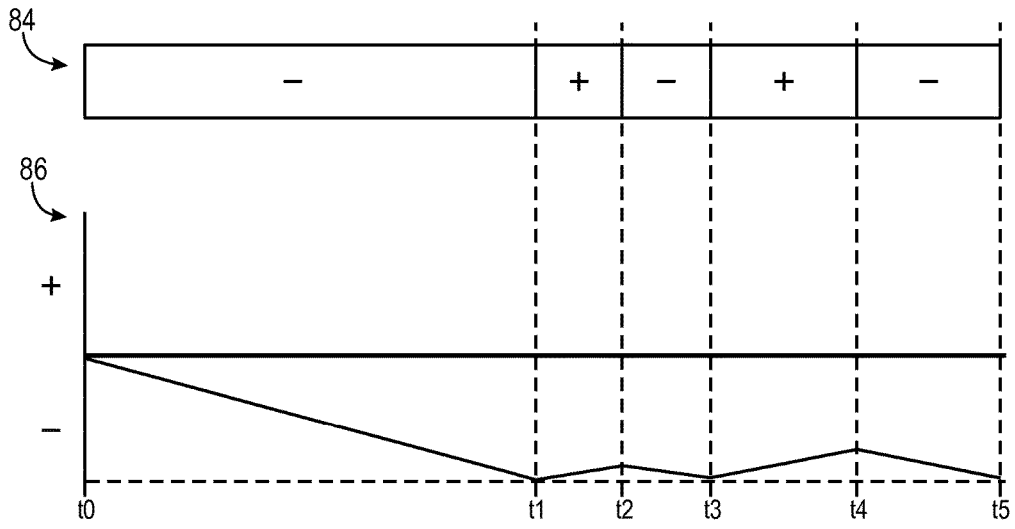
FIG. 10 is an example of a second hypothetical operation of an electronic display, in accordance with an embodiment.

As described above, displaying images at a reduced refresh rate may reduce energy consumption by the electronic display 12. Accordingly, in some embodiments, it may be desirable to maintain the electronic display 12 in a reduced refresh mode, in which successive image frames are displayed at a reduced refresh rate even when the display panel is polarized. To help illustrate the techniques, a hypothetical display operation 84 is described in FIG. 10 based on the same image data as used in the hypothetical display operation 80 described in FIG. 9. More specifically, the hypothetical display operation 84 describes image frames displayed on the electronic display 12 between t0 and t5'. Additionally, a counter value plot 86 describes the counter value in relation to the hypothetical display operation 84.

As depicted, the hypothetical display operation 84 may be generally the same as the hypothetical display operation 80 between t0 and t4. More specifically, between t0 and t1, the timing controller 38 may instruct the display driver 40 to apply the first set of voltage polarities to the display panel at the reduced refresh rate to display the first image frame, between t1 and t2, the timing controller 38 may instruct the display driver 40 to apply the second set of voltage polarities to the display panel at the normal refresh rate to display the second image frame, between t2 and t3, the timing controller 38 may instruct the display driver 40 to apply the first set of voltage polarities to the display panel at the normal refresh rate to display the third image frame, and between t3 and t4, timing controller 38 may instruct the display driver 40 to apply the second set of voltage polarities to the display panel at the reduced refresh rate to display the third image frame between t3 and t4. In other words, the timing controller 38 may instruct the electronic display 12 to enter a reduced refresh mode.

At t4, the timing controller 38 may receive fifth image data, which has a desired reduced refresh rate (e.g., 30 Hz). Since the electronic display 12 is in a reduced refresh mode, the timing controller 38 may determine whether to remain in the reduced refresh mode. More specifically, the timing controller 38 may determine whether to remain in the reduced refresh modes based on whether the desired refresh rate describes in the fifth image data is greater than or equal to the refresh rate used to display the fourth image frame. For example, in the depicted embodiment, since the desired refresh rate is greater than or equal, the timing controller 38 may determine that the electronic display 12 may remain in the reduced refresh mode. As such, the timing controller 38 may instruct the display driver 40 to apply the first set of voltage polarities to the display panel at the reduced refresh rate to display a fifth image frame between t4 and t5'. Accordingly, as depicted, the counter value decreases between t4 and t5' to indicate the duration the negative polarity voltage is applied to the pixel.

On the other hand, when the desired refresh rate is less than the refresh rate used to display the fourth image frame, the timing controller 38 may determine that it is desirable to briefly exit the reduced refresh mode to reduce the likelihood of the accumulated inversion imbalance exceeding the bounds (e.g., value at t1). More specifically, the timing controller 38 may instruct the display driver 40 to apply the first set of voltage polarities to the display panel at the normal refresh rate to display a fifth image frame, and based on the fifth image data, to apply the second set of voltage polarities to the display panel at the desired reduced refresh rate to display a sixth image frame.

Figure 11:
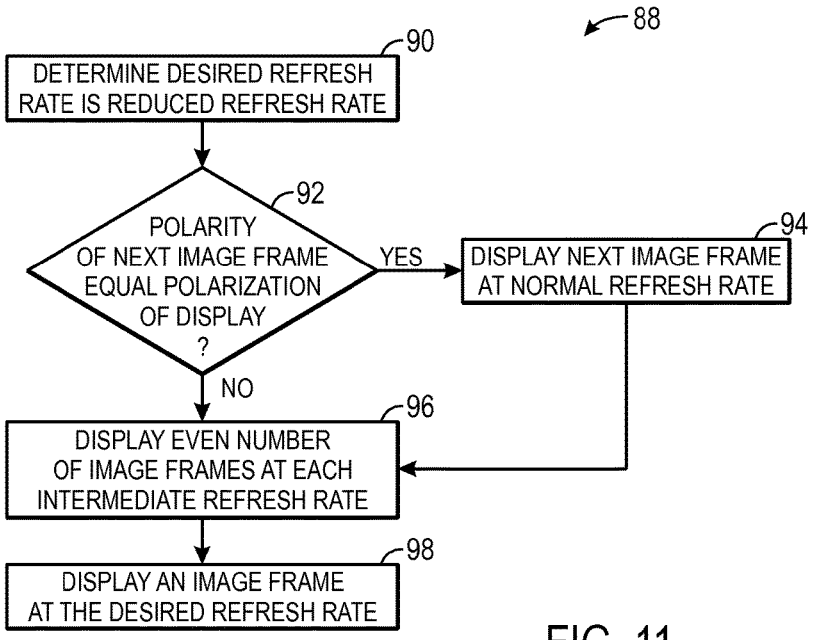
FIG. 11 is a flow diagram of another process for determining refresh rate with which to display image frames, in accordance with an embodiment.

As described above, in some embodiments, intermediate step-down refresh rates may be used to reduce perceivability of changes to the refresh rate with which image frames are displayed. To help illustrate, a process 88 for displaying one or more image frame is described in FIG. 11. Generally, the process 88 includes determining that a desired refresh rate is a reduced refresh rate (process block 90), determining whether polarity with which to display a next image frame is equal to the polarization of the electronic display (decision block 92), displaying the next image frame at a normal refresh rate when the polarity with which to display the next image frame is equal to the polarization of the electronic display (process block 94), displaying an even number of image frames at each intermediate refresh rate (process block 96), and displaying an image frame at the desired refresh rate (process block 98). In some embodiments, the process 88 may be implemented using instructions stored in the timing controller memory 44 and/or another suitable tangible non-transitory computer-readable medium and executable by the timing controller processor 42 and/or another suitable processing circuitry.

Similar to process 58, the timing controller 38 may determine whether the desired refresh rate is a reduced refresh rate (process block 90). More specifically, when the desired refresh rate is less than the normal refresh rate of the electronic display 12, the timing controller 38 may determine that the desired refresh rate is a reduced refresh rate. The timing controller 38 may then determine whether polarity with which to display the next image frame is equal to the polarization of the electronic display 12 (decision block 92). Additionally, when the timing controller 38 determines that they are equal, the timing controller 38 may instruct the display driver 40 to display the next image frame at a normal refresh rate (process block 94).

The timing controller 38 may then instruct the display driver 40 to display an even number of image frames at one or more intermediate refresh rates (process block 96). More specifically, the timing controller 38 may instruct the display driver 40 to display image frames at one or more intermediate refresh rates when the desired refresh rate is less than the refresh rate with which a directly previous image frame is displayed. Generally, the threshold amount may be set so that changes in refresh rate greater than the threshold amount may be perceivable by a user's eyes.

Thus, to reduce or at least maintain the accumulated inversion imbalance, an even number of image frames may be displayed at each intermediate refresh rate. For example, a first image frame may be displayed at an intermediate refresh rate (e.g., 45 Hz) by applying the first set of voltage polarities and a second image frame may be displayed at the intermediate refresh rate by applying the second set of voltage polarities. In this manner, the polarization caused by displaying the first image frame and the second image frame may cancel out and at least maintain (e.g., not make worse) the accumulated inversion imbalance.

The timing controller 38 may then instruct the display driver 40 to display an image frame at the desired refresh rate (process block 98). As such, the polarization of the electronic display 12 may be decreased or at least maintained while also reducing the peceivability of a reduced refresh rate by gradually reducing the refresh rate of the electronic display 12 using intermediate refresh rates.

As described above, various inversion techniques may be used to write image frames to the electronic display 12. More specifically, in each inversion technique, the voltage polarity applied to a pixel to successively display image frames generally alternates between positive and negative polarities. As such, it may be possible to extrapolate the determined refresh rate of a single pixel to each of the pixels on the electronic display.

Figure 12:
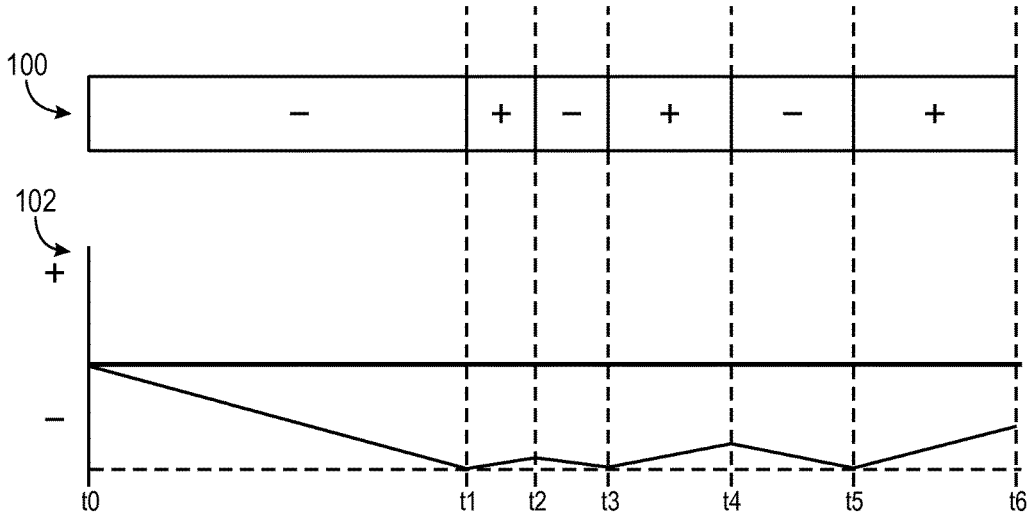
FIG. 12 is an example of a third hypothetical operation of an electronic display, in accordance with an embodiment.

To help illustrate the techniques, a hypothetical display operation 100 is described in FIG. 12 with regard to a single pixel. More specifically, the hypothetical display operation 100 describes image frames displayed on the electronic display 12 between t0 and t6. Additionally, a counter value plot 102 describes the counter value in relation to the hypothetical display operation 100.

As depicted, the hypothetical display operation 100 may be generally the same as the hypothetical display operation 80 between t0 and t3. More specifically, between t0 and t1, the timing controller 38 may instruct the display driver 40 to apply the first set of voltage polarities to the display panel at the reduced refresh rate to display the first image frame, between t1 and t2, the timing controller 38 may instruct the display driver 40 to apply the second set of voltage polarities to the display panel at the normal refresh rate to display the second image frame, and between t2 and t3, the timing controller 38 may instruct the display driver 40 to apply the first set of voltage polarities to the display panel at the normal refresh rate to display the third image frame.

At t3, the timing controller 38 may receive fourth image data, which has a desired reduced refresh rate (e.g., 30 Hz). Since the desired refresh rate is a reduced refresh rate, the timing controller 38 may compare the voltage polarity with which to write a next image frame and polarization of the pixel. More specifically, since the third image frame was displayed by applying a negative polarity, the timing controller 38 may determine that the fourth image frame may be displayed by applying a positive polarity. Additionally, the timing controller 38 may determine that the pixel is polarized negative because the counter value is negative.

Since the polarities are opposite, the timing controller 38 may instruct the display driver 40 to determine whether the desired refresh rate in the fourth image data is lower than the refresh rate used to display the third image frame by more than a threshold amount. As in the depicted embodiment, when the desired refresh rate is lower by more than the threshold amount, the timing controller 38 may instruct the display driver 40 to apply the first set of voltage polarities to the display panel at an intermediate refresh rate (e.g., 45 Hz) to display a fourth image frame between t3 and t4 and to apply the second set of voltage polarities to the display at the intermediate refresh to display a fifth image frame between t4 and t5.

In some embodiments, the fourth image frame and the fifth image frame may be displayed based on the third image data (e.g., repeat display of third image frame), the fourth image data, or a combination thereof. For example, the fourth and fifth image frames may both be displayed based on the third image data or the fourth image data. Additionally or alternatively, the fourth image frame may be based on the third image data and the fifth image frame may be based on the fourth image data. Regardless, as depicted, the counter value increases between t3 and t4 to indicate the duration the positive polarity voltage is applied to the pixel and decreases between t4 and t5 to indicate the duration the negative polarity is applied to the pixel.

Once an even number of image frames is displayed at the intermediate refresh rate, the timing controller 38 may instruct the display driver 40 to apply the first set of voltage polarities to the display panel at the desired (e.g., target) refresh rate based on the fourth image data to display a sixth image frame between t5 and t6. Thus, as depicted, the counter value increases between t5 and t6 to indicate the duration the positive polarity voltage is applied to the pixel. In this manner, the inversion imbalance accumulated by the pixel and the display panel as a whole may be gradually reduced while reducing the perceivability of reductions of refresh rate with which image frames are displayed.

Figure 13:
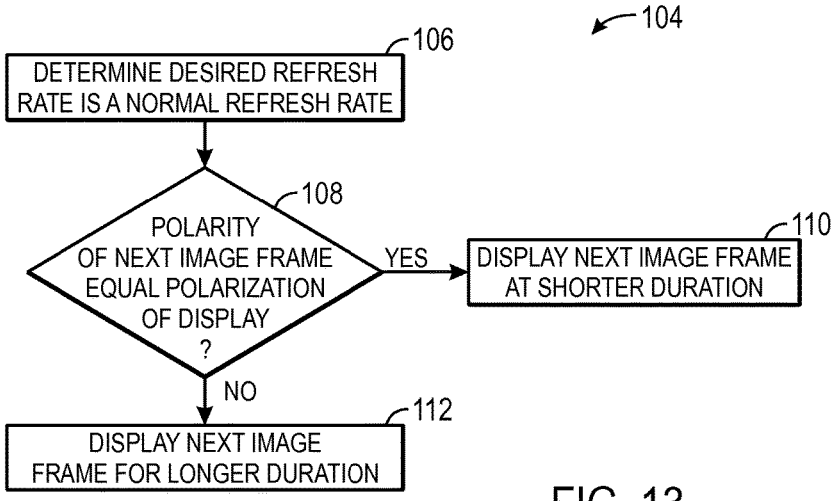
FIG. 13 is a flow diagram of a further process for determining refresh rate with which to display image frames, in accordance with an embodiment.

As described above, in some embodiments, the determined refresh rate may deviate from a desired normal refresh rate to facilitate reducing inversion imbalance in the electronic display 12. To help illustrate, a process 104 for displaying one or more image frame is described in FIG. 13.

Generally, the process 104 includes determining that a desired refresh rate is a normal refresh rate (process block 106), determining whether polarity with which to display a next image frame is equal to the polarization of the electronic display (decision block 108), displaying the next image frame for a shorter duration when the polarity with which to display the next image frame is equal to the polarization of the electronic display (process block 110), and displaying the next image frame for a longer duration when the polarity with which to display the next image frame is not equal to the polarization of the electronic display (process block 112). In some embodiments, the process 104 may be implemented using instructions stored in the timing controller memory 44 and/or another suitable tangible non-transitory computer-readable medium and executable by the timing controller processor 42 and/or another suitable processing circuitry.

Accordingly, the timing controller 38 may determine whether the desired refresh rate is a normal refresh rate (e.g., 60 Hz) (process block 106). In some embodiments, the normal refresh rate (e.g., 60 Hz) may be stored in memory 44. Accordingly, the timing controller 38 may retrieve and compare the normal refresh rate with the desired refresh rate.

More specifically, when the desired refresh rate is equal to the normal refresh rate, the timing controller 38 may then determine whether polarity with which to display the next image frame is equal to the polarization of the electronic display 12 (decision block 108). When the timing controller 38 determines that their polarities are equal, the timing controller 38 may instruct the display driver 40 to display the next image frame for a shorter duration (process block 110). More specifically, in some embodiments, the next image frame may be displayed at a higher refresh rate, such as 65 Hz, 90 Hz, 120 Hz, or greater. On the other hand, when the timing controller 38 determines that they are not equal, the timing controller 38 may instruct the display driver 40 to display the next image frame for a longer duration (process block 112). More specifically, in some embodiments, the next image frame may be displayed at a lower refresh rate, such as 60 Hz, 55 Hz, 30 Hz, or lower (process block 112). In this manner, the polarization of the electronic display 12 may be decreased by displaying image frames written with a set of voltage polarities opposite the polarization of the electronic display 12 for a longer duration. The paring between short and long frame may be determined by the timing controller 38 to improve screening performance issue.

Figure 14:
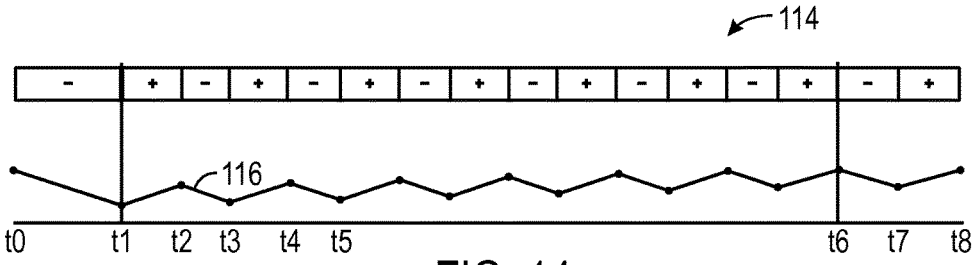
FIG. 14 is an example of a fourth hypothetical operation of an electronic display, in accordance with an embodiment.

To help illustrate the techniques, a hypothetical display operation 114 is described in FIG. 14 with regard to a single pixel. More specifically, the hypothetical display operation 114 describes image frames displayed on the electronic display 12 between t0 and t8. Additionally, a counter value plot 116 describes the counter value in relation to the hypothetical display operation 114.

In the depicted embodiment, the timing controller 38 may receive first image data at t0, which has a desired reduced refresh rate. Based on the first image data, the timing controller 38 may instruct the display driver 40 to apply the first set of voltage polarities to the display panel at the reduced refresh rate to display a first image frame between t0 and t1. More specifically, the first set of voltage polarities may apply a negative polarity voltage to the pixel. Thus, as depicted, the counter value decreases between t0 and t1 to indicate the duration the negative polarity voltage is applied to the pixel (e.g., duration the first set of voltage polarities is applied to the display panel).

At t1, the timing controller 38 may receive second image data, which has a desired normal refresh rate (e.g., 60 Hz). Additionally, the timing controller 38 may determine that a second image frame may be displayed by applying a second set of voltage polarities (e.g., positive polarity to the pixel). Accordingly, since the second set of voltage polarities is opposite the polarization of the pixel, the timing controller 38 may determine that the second image frame may be displayed at a lower refresh rate (e.g., 55 Hz) between t1 and t2. Thus, as depicted, the counter value increases between t1 and t2 to indicate the duration the positive polarity voltage is applied to the pixel (e.g., duration the second set of voltage polarities is applied to the display panel).

At t2, the timing controller 38 may receive third image data, which has a desired normal refresh rate (e.g., 60 Hz). Additionally, the timing controller 38 may determine that a third image frame may be displayed by applying the first set of voltage polarities (e.g., negative polarity to the pixel). Accordingly, since the first set of voltage polarities is the same polarity as the polarization of the pixel, the timing controller 38 may determine that the third image frame may be displayed at a higher refresh rate (e.g., 65 Hz) between t2 and t3. Thus, as depicted, the counter value decreases between t2 and t3 to indicate the duration the negative polarity voltage is applied to the pixel (e.g., duration the first set of voltage polarities is applied to the display panel).

At t3, the timing controller 38 may receive fourth image data, which has a desired normal refresh rate (e.g., 60 Hz). Additionally, the timing controller 38 may determine that a fourth image frame may be displayed by applying a second set of voltage polarities (e.g., positive polarity to the pixel). Accordingly, since the second set of voltage polarities is opposite the polarization of the pixel, the timing controller 38 may determine that the fourth image frame may be displayed at a lower refresh rate (e.g., 55 Hz) between t3 and t4. Thus, as depicted, the counter value increases between t3 and t4 to indicate the duration the positive polarity voltage is applied to the pixel (e.g., duration the second set of voltage polarities is applied to the display panel).

At t4, the timing controller 38 may receive fifth image data, which has a desired normal refresh rate (e.g., 60 Hz). Additionally, the timing controller 38 may determine that a fifth image frame may be displayed by applying the first set of voltage polarities (e.g., negative polarity to the pixel). Accordingly, since the first set of voltage polarities is the same polarity as the polarization of the pixel, the timing controller 38 may determine that the third image frame may be displayed at a higher refresh rate (e.g., 65 Hz) between t4 and t5. Thus, as depicted, the counter value decreases between t4 and t5 to indicate the duration the negative polarity voltage is applied to the pixel (e.g., duration the first set of voltage polarities is applied to the display panel).

As depicted, the image frames may be displayed by alternating display of image frames using the second set of voltage polarities at a lower refresh rate (55 Hz) and image frames using the first set of voltage polarities at a higher refresh rate (e.g., 60 Hz) until polarization of the pixel is approximately zero at t6. Thereafter, the image frames may be displayed at the desired normal refresh rate. For example, in the depicted embodiment, at t6, the timing controller 38 may instruct the display driver 40 to display an image frame at the desired normal refresh rate (e.g., 60 Hz) by applying the first set of voltage polarities and, at t7, instruct the display driver 40 to display an image frame at the desired normal fresh rate by applying the second set of voltage polarities. In this manner, the inversion imbalance of the pixel, and the display panel as a whole, may be gradually reduced.

Figure 15:
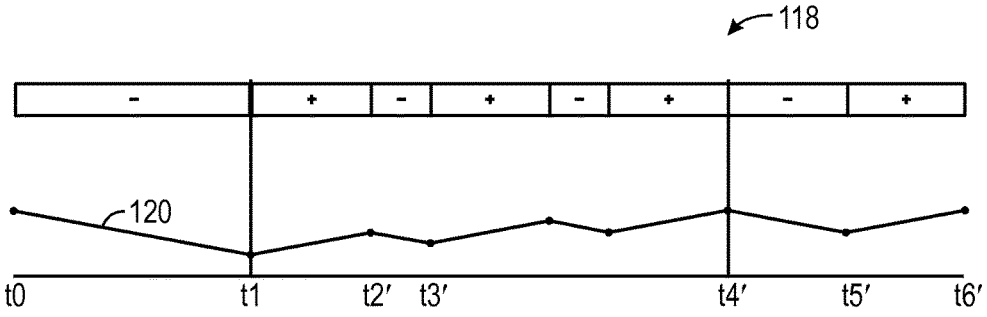
FIG. 15 is an example of a fifth hypothetical operation of an electronic display, in accordance with an embodiment.

In other words, the inversion imbalance may be gradually reduced by increasing display duration of image frames written using a set of voltage polarities opposite polarization of the display panel and/or by decreasing display duration of image frames written using a set of voltage polarities the same polarity as polarization of the display panel. To further illustrate, a hypothetical display operation 118 is described in FIG. 15 with regard to a single pixel based on the same image data as used in the hypothetical display operation 114 described in FIG. 15. More specifically, the hypothetical display operation 118 describes image frames displayed on the electronic display 12 between t0 and t6'. Additionally, a counter value plot 120 describes the counter value in relation to the hypothetical display operation 118.

Similar to hypothetical operation 114, between t0 and t1, the timing controller 38 may instruct the display driver 40 to apply the first set of voltage polarities to the display panel at the reduced refresh rate to display the first image frame. At t1, the timing controller 38 may receive second image data, which has a desired normal refresh rate (e.g., 60 Hz). Additionally, the timing controller 38 may determine that a second image frame may be displayed by applying a second set of voltage polarities (e.g., positive polarity to the pixel). Since the since the second set of voltage polarities is opposite the polarization of the pixel, the timing controller 38 may determine that the second image frame may be displayed at the desired normal refresh rate (e.g., 60 Hz) between t1 and t2'. Thus, as depicted, the counter value increases between t1 and t2' to indicate the duration the positive polarity voltage is applied to the pixel (e.g., duration the second set of voltage polarities is applied to the display panel).

As depicted, the image frames may be displayed by alternating display of image frames using the second set of voltage polarities at the desired normal refresh rate (e.g., 60 Hz) and image frames using the first set of voltage polarities at a higher refresh rate (e.g., 120 Hz) until polarization of the pixel is approximately zero at t4'. Thereafter, the image frames may be displayed at the desired normal refresh rate. For example, in the depicted embodiment, at t4', the timing controller 38 may instruct the display driver 40 to display an image frame at the desired normal refresh rate (e.g., 60 Hz) by applying the first set of voltage polarities and, at t5', instruct the display driver 40 to display an image frame at the desired normal fresh rate by applying the second set of voltage polarities. In this manner, the inversion imbalance of the pixel, and the display panel as a whole, may be gradually reduced.

In other embodiments, the inversion imbalance may be gradually reduced by alternating display of image frames using the second set of voltage polarities at a lower refresh rate (e.g., 30 Hz or 45 Hz) and image frames using the first set of voltage polarities at the desired normal refresh rate (e.g., 60 Hz) until polarization of the pixel is approximately zero.

Accordingly, the technical effects of the present disclosure include improving image display accuracy by an electronic display particularly when the electronic display uses a dynamic variable refresh rate. More specifically, the inversion imbalance accumulated in pixels of the electronic display may be bounded to reduce the likelihood of polarizing the pixels to the point of causing perceivable visual artifacts. For example, in some embodiments, an image frame displayed at a reduced refresh rate may be written to the pixels using a set of voltage polarities opposite to the polarization of the pixels. Additionally, in some embodiments, an even number of image frames may be displayed at intermediate step-down refresh rates. Furthermore, in some embodiments, image frames may be displayed at a refresh rate different from a desired normal refresh rate to gradually reduce accumulated inversion imbalance. In this manner, the accumulated inversion imbalance may be bounded and gradually reduced.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. An electronic display comprising:

a display panel configured to display image frames with a first refresh rate or a second refresh rate, wherein the second refresh rate is lower than the first refresh rate;

a display driver configured to write the image frames to the display panel by applying voltage to the display panel; and a timing controller configured to:

receive first image data from an image source communicatively coupled to the electronic display, wherein the first image data describes a first image frame and a first desired refresh rate with which to display the first image frame, wherein the first desired refresh rate is equal to the second refresh rate; and instruct the display driver to apply a first set of voltage polarities to the display panel such that the first image frame is displayed at the first refresh rate and to apply a second set of voltage polarities to the display panel such that the first image frame is displayed at the second refresh rate when polarity of inversion imbalance accumulated in the display panel is equal to polarity of the first set of voltage polarities.

2. The electronic display of claim 1, wherein the timing controller comprises a counter configured to facilitate determining the polarity of the inversion imbalance accumulated in the display panel by incrementing when the first set of voltage polarities is applied and decrementing when the second set of voltage polarities is applied.

3. The electronic display of claim 2, wherein the counter comprises a counter value configured to be positive when the display panel is polarized toward the first set of voltage polarities and to be negative when the display panel is polarized toward the second set of voltage polarities.

4. The electronic display of claim 1, wherein the timing controller is configured to:

receive second image data from the image source, wherein the second image data describes a second image frame and a second desired refresh rate with which to display the second image frame, wherein the second desired refresh rate is equal to the second refresh rate; and instruct the display driver to apply the first set of voltage polarities to the display panel such that the second image frame is displayed at the second refresh rate when the polarity of the inversion imbalance accumulated in the display panel is opposite to the polarity of the first set of voltage polarities.

5. The electronic display of claim 1, wherein the display driver is configured to apply the first set of voltage polarities by applying positive polarity voltages to odd columns of the display panel and negative polarity voltages to even columns of the display panel, and to apply the second set of voltage polarities by applying negative polarity voltages to the odd columns and positive polarity voltages to the even columns.

6. The electronic display of claim 1, wherein the display driver is configured to alternate between applying the first set of voltage polarities to the display panel and applying the second set of voltage polarities to the display panel, wherein polarity of the second set of voltage polarities is opposite the polarity of the first set of voltage polarities.

7. The electronic display of claim 1, wherein the first refresh rate is 60 Hz and the second refresh rate is 30 Hz.

8. A method comprising:

determining, using a timing controller of an electronic display, a desired refresh rate of an image frame described by image data received from an image source communicatively coupled to the electronic display;

determining, using the timing controller, whether the desired refresh rate is lower than a first refresh rate of the electronic display; and instructing, using the timing controller, the electronic display to display the image frame at the first refresh rate by applying a first set of voltage polarities and to display the image frame at the desired refresh rate by applying a second set of voltage polarities when:

the desired refresh rate is lower than the first refresh rate; and polarity of the first set of voltage polarities is equal to polarity of inversion imbalance accumulated in the electronic display.

9. The method of claim 8, comprising:

determining, using the timing controller, whether the desired refresh rate is lower than the first refresh rate by more than a threshold amount; and when the desired refresh rate is lower than the first refresh rate by more than the threshold amount:

instructing, using the timing controller, the electronic display to display the image frame at an intermediate step-down refresh rate by applying the first set of voltage polarities; and instructing, using the timing controller, the electronic display to display the image frame at the intermediate step-down refresh rate by applying the second set of voltage polarities;

wherein the intermediate step-down refresh rate is higher than the desired refresh rate and lower than the first refresh rate.

10. The method of claim 9, wherein the first refresh rate is 60 Hz, the intermediate step-down refresh rate is 45 Hz, and the desired refresh rate is 30 Hz.

11. The method of claim 8, comprising instructing, using the timing controller, the electronic display to display the image frame at the desired refresh rate by applying the first set of voltage polarities when the polarity of the first set of voltage polarities is opposite the polarity of the inversion imbalance accumulated in the electronic display.

12. The method of claim 8, wherein determining the desired refresh rate comprises determining number of vertical blank lines and active lines included in the image data.

13. The method of claim 8, comprising:

determining, using the timing controller, that the desired refresh rate is the first refresh rate; and instructing, using the timing controller, the electronic display to, when polarity of the first set of voltage polarities is not equal to polarity of the inversion imbalance accumulated in the electronic display:

display the image frame at the first refresh rate and a next image frame at a second refresh rate higher than the first refresh rate;

display the image frame at a third refresh rate lower than the first refresh rate and the next image frame at the first refresh rate; or display the image frame at a fourth refresh rate lower than the first refresh rate and the next image frame at a fifth refresh rate higher than the first refresh rate.

14. A tangible, non-transitory, computer readable medium storing instructions executable by a processor of an electronic display, wherein the instructions comprise instructions to:

determine, using the processor, that a desired refresh rate indicated by received image data is lower than a first refresh rate of the electronic display;

determine, using the processor, that polarity of a first set of voltage polarities with which to display a next image frame is equal to polarity of inversion imbalance accumulated by pixels in the electronic display;

instruct, using the processor, the electronic display to display a first image frame at the first refresh rate; and instruct, using the processor, the electronic display to display a second image frame at the desired refresh rate based on the received image data.

15. The tangible, non-transitory, computer readable medium of claim 14, wherein the polarity of the first set of voltage polarities and the polarity of inversion imbalance accumulated comprise positive polarity voltages at odd numbered columns and negative polarity voltages at even numbered columns.

16. The tangible, non-transitory, computer readable medium of claim 14, wherein the polarity of the first set of voltage polarities and the polarity of inversion imbalance accumulated comprise negative polarity voltages at odd numbered columns and positive polarity voltages at even numbered columns.

17. The tangible, non-transitory, computer readable medium of claim 14, wherein the first image frame is the same as the second image frame.

18. The tangible, non-transitory, computer readable medium of claim 14, wherein the instructions to instruct the electronic display to display the first image frame comprises instructions to repeat an image frame displayed immediately prior to the first image frame.

19. The tangible, non-transitory, computer readable medium of claim 14, wherein the instructions to instruct the electronic display to display the second image frame comprises instructions to instruct the electronic display to display the second image frame at a refresh rate half a refresh rate used to display the first image frame.

20. An electronic display comprising:

a display panel configured to display image frames with a first refresh rate, a second refresh rate, or a third refresh rate, wherein the third refresh rate is lower than the second refresh rate and the first refresh rate, and the second refresh rate is lower than the first refresh rate;

a display driver configured to write the image frames to the display panel by applying voltage to the display panel; and a timing controller configured to:

receive first image data from an image source communicatively coupled to the electronic display, wherein the first image data describes a first image frame and a first desired refresh rate with which to display the first image frame, wherein the first desired refresh rate is equal to the third refresh rate; and instruct the display driver to apply a first set of voltage polarities to the display panel such that the first image frame is displayed at the second refresh rate and to apply a second set of voltage polarities to the display panel such that the first image frame is displayed at the second refresh rate when:

an image frame display immediately prior is displayed at the first refresh rate; and the first refresh rate is greater than the third refresh rate by more than a threshold amount.

21. The electronic display of claim 20, wherein the timing controller is configured to instruct the display driver to apply the second set of voltage polarities to the display panel such that the first image frame is displayed at the first refresh rate before displaying the first image frame at the second refresh rate when polarity of inversion imbalance accumulated in the display panel is equal to polarity of the second set of voltage polarities.

22. The electronic display of claim 20, wherein the timing controller is configured to:

receive second image data from the image source, wherein the second image data describes a second image frame and a second desired refresh rate with which to display the second image frame, wherein the second desired refresh rate is equal to the third refresh rate; and instruct the display driver to apply the first set of voltage polarities to the display panel such that the first image frame is displayed at the third refresh rate when:

polarity of inversion imbalance accumulated in the display panel is opposite polarity of the first set of voltage polarities;

an image frame display immediately prior is displayed at the first refresh rate; and the first refresh rate is not greater than the third refresh rate by more than the threshold amount.

23. The electronic display of claim 20, wherein the first refresh rate is 60 Hz, the second refresh rate is 45 Hz, and the third refresh rate is 30 Hz.

24. A method comprising:

determining, using a timing controller of an electronic display, a desired refresh rate described by image data received from an image source communicatively coupled to the electronic display;

determining, using the timing controller, a previous refresh rate used to display a directly previous image frame on the electronic display;

when the desired refresh rate is more than a threshold amount lower than the previous refresh rate:

instructing, using the timing controller, the electronic display to display a first image frame at a step-down refresh rate, wherein the step-down refresh rate is between the previous refresh rate and the desired refresh rate; and instructing, using the timing controller, the electronic display to display a second image frame at the step-down refresh rate; and instructing, using the timing controller, the electronic display to display a third image frame at the desired refresh rate based on the received image data.

25. The method of claim 24, wherein:

instructing the electronic display to display the first image frame comprises instructing the electronic display to apply a first set of voltage polarities to pixels of the electronic display; and instructing the electronic display to display the second image frame comprises instructing the electronic display to apply a second set of voltage polarities to the pixels;

wherein polarity of the first set of voltage polarities is opposite polarity of the second set of voltage polarities.

26. The method of claim 24, wherein the first image frame is the same as the directly previous image frame, and the second image frame is the same as the third image frame.

27. The method of claim 24, wherein the directly previous refresh rate is 60 Hz, the step-down refresh rate is 45 Hz, and the desired refresh rate is 30 Hz.

28. A tangible, non-transitory, computer readable medium storing instructions executable by a processor of an electronic display, wherein the instructions comprise instructions to:

determine, using the processor, that a desired refresh rate indicated by first image data is a first refresh rate, wherein the first image data describes a first image frame to be displayed on the electronic display;

determine, using the processor, that a desired refresh rate indicated by second image data is the first refresh rate, wherein the second image data describes a second image frame to be displayed successively after the first image frame;

determine, using the processor, whether polarity of a first set of voltage polarities with which to display the first image frame is equal to polarity of inversion imbalance;

instruct, using the processor, the electronic display to display the first image frame a longer duration than the second image frame when polarity of the first set of voltage polarities is not equal to polarity of the inversion imbalance accumulated in pixels of the electronic display.

29. The computer-readable medium of claim 28, wherein the instruction to instruct the electronic display to display the first image frame a longer duration than the second image frame comprises instructions to:

display the first image frame at the first refresh rate and the second image frame at a second refresh rate higher than the first refresh rate;

display the first image frame at a third refresh rate lower than the first refresh rate and the second image frame at the first refresh rate; or display the first image frame at a fourth refresh rate lower than the first refresh rate and the second image frame at a fifth refresh rate higher than the first refresh rate.

30. The computer-readable medium of claim 28, comprising instructions to, when accumulated inversion imbalance is equal to zero:

instruct, using the processor, the electronic display to display the first image frame at the first refresh rate; and instruct, using the processor, the electronic display to display the second image frame at the first refresh rate.

* * * * *